US009383711B2

(12) United States Patent
Pezdek et al.

(10) Patent No.: US 9,383,711 B2
(45) **Date of Patent: *Jul. 5, 2016**

(54) INTERLOCK/CONNECTOR SYSTEM FOR A REPLACEABLE ITEM FOR AN IMAGE FORMING DEVICE

(71) Applicant: Lexmark International, Inc., Lexington, KY (US)

(72) Inventors: John Victor Pezdek, Lexington, KY (US); Justin Michael Tromp, Louisville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/725,177

(22) Filed: May 29, 2015

(65) Prior Publication Data

US 2015/0261169 A1 Sep. 17, 2015

Related U.S. Application Data

(63) Continuation of application No. 13/899,910, filed on May 22, 2013, now Pat. No. 9,046,868.

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.
CPC ..... *G03G 15/80* (2013.01); *G03G 21/16* (2013.01); *G03G 21/1821* (2013.01)

(58) Field of Classification Search
CPC .... G03G 15/80; G03G 21/16; G03G 21/1821
See application file for complete search history.

(56) References Cited

U.S. PATENT DOCUMENTS 9,046,868 B2 * 6/2015 Pezdek ..... G03G 21/16

* cited by examiner

*Primary Examiner* — Roy Y Yi
(74) *Attorney, Agent, or Firm* — John Victor Pezdek; Justin M Tromp

(57) ABSTRACT

A connector having a magnetically attractable support loosely attachable to an exterior surface of the replaceable item for use in an image forming device. The connector is interconnectable with a second connector of the image forming device, the second connector having a magnet adjacent to an operating position of the replaceable item wherein when the connector is attached to the replaceable item and the replaceable item is in the operating position, a magnetic field draws the support away from the replaceable item and the connector into operational contact with the second connector. The mounting of the support allows the support to be drawn away from the replaceable item and remain attached thereto.

8 Claims, 7 Drawing Sheets

INTERLOCK/CONNECTOR SYSTEM FOR A REPLACEABLE ITEM FOR AN IMAGE FORMING DEVICE

CROSS REFERENCES TO RELATED APPLICATIONS

This patent application is a continuation application of U.S. patent application Ser. No. 13/899,910, filed May 22, 2013, entitled "Interlock/Connector System for a Replaceable Item for an Image Forming Device."

BACKGROUND

1. Field of the Disclosure

The present disclosure relates generally to replaceable items used in electrophotographic image forming devices and, more particularly, to an interlock for a replaceable item actuated when the replaceable item is positioned within the image forming device.

2. Description of the Related Art

In order to reduce the premature replacement of components used in an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable item commonly referred to as an imaging unit. The image forming device's toner supply, which is consumed relatively quickly in comparison with the components housed in the imaging unit, is provided in a reservoir in a separate replaceable item in the form of a toner cartridge that mates with the imaging unit. In this configuration, the number of components housed in the toner cartridge is reduced in comparison with traditional toner cartridges.

Onboard such replaceable items, an interlock may be provided for safety purposes to complete a circuit allowing for the operation of the image forming device or a sub-system thereof, such as a laser scanning unit. Further, also provided on the replaceable items is processing circuitry used to store information about the replaceable item such as life, printing variables, etc. The processing circuitry is typically mounted on a circuit board on the replaceable item such that the contacts on the circuit board connect with corresponding contacts in the image forming device to allow for communication between the processing circuitry and the processor of the image forming device when the replaceable item is installed in the image forming device. As such, it is important to accurately position the replaceable item in the image forming device. Further, to establish a reliable electrical connection, interconnection between the image forming device and the replaceable item may exert force on the replaceable item. However, the force balance between the toner cartridge and the imaging unit is delicate because an imbalance of forces can cause print defects.

Accordingly, it will be appreciated that it is desirable to have an interlock/connector system for providing reliable electrical connection between a replaceable item when positioned within the image forming device for establishing electrical communication between the replaceable item's processing circuitry and/or interlocks and the processor of the image forming device while minimizing external forces on the replaceable item.

SUMMARY

Provided is a connector having a magnetically attractable support that is loosely attachable to an exterior surface of the replaceable item that is used in an image forming device. The connector is interconnectable with a second connector of the image forming device. The second connector includes a magnet and is positioned adjacent to an operating position of the replaceable item. When the connector is attached to the replaceable item and the replaceable item is in the operating position, a magnetic field draws the support away from the replaceable item and draws the connector into operational contact with the second connector. The mounting of the support allows the support to be drawn away from the replaceable item and remain attached thereto. In a further form, the magnet may be an electromagnet. In a still further form, the support of the connector loosely attached to the replaceable item includes a ferromagnetic plate or a magnet.

BRIEF DESCRIPTION OF THE DRAWINGS

The above-mentioned and other features and advantages of the various embodiments, and the manner of attaining them, will become more apparent and will be better understood by reference to the accompanying drawings.

FIG. 5A shows a replaceable item approaching its seated or operational position within an image forming device while FIG. 5B shows the actuated connector/interlock system of the replaceable item and the image forming device when the replaceable item is in its seated or operational position.

DETAILED DESCRIPTION

Figure 1:
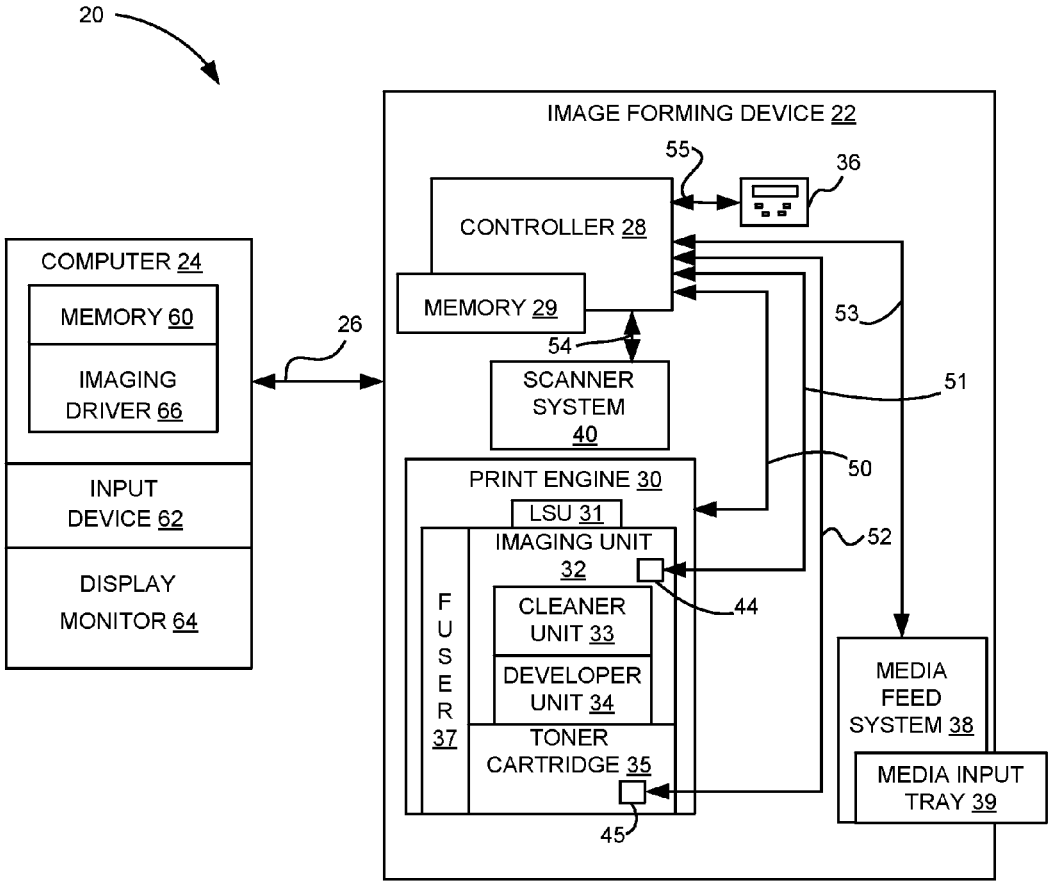
FIG. 1 is a block diagram of an imaging system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "under", "below", "lower", "over", "upper", and the like, are used for ease of description to explain the positioning of one element relative to a second element. These terms are generally used in reference to the position of an element in its intended operational position within an image forming device. For example, the front or proximal portion of a replaceable item or component thereof is that portion of either that first enters the image forming device in the insertion direction. This may also be termed the proximal end, leading portion, leading edge. Similarly, the rear, back or distal portion of the same element or the trailing edge would be upstream with respect to the insertion direction. In general, a large single ended arrow is provided to show the insertion direction. Further, terms such as "first", "second", and the like, are used to describe various elements, regions, sections, etc. and are not intended to be limiting. The term "image" as used herein encompasses any printed or digital form of text, graphic, or combination thereof Like terms refer to like elements throughout the description.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any processing device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, network server, tablet computer, smartphone, or other hand-held electronic device including memory 60, such as volatile and/or non volatile memory, an input device 62, such as a keyboard and/or a mouse, and a display 64, such as a monitor. Computer 24 also includes a processor, input/output (I/O) interfaces, and may include at least one mass data storage device, such as a hard drive, a CD-ROM and/or a DVD unit (not shown).

Computer 24 includes in its memory 60 a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and a fuser 37, all mounted within image forming device 22. Imaging unit 32 and toner cartridge 35 are supported in their operating positions by a frame 90 (see FIG. 3) which allows for toner cartridge 35 to be operatively mated to the imaging unit 32 while minimizing any unbalanced loading forces by the toner cartridge 35 on imaging unit 32.

Imaging unit 32 is removably mounted in the frame 90 of image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Cleaner unit 33 and developer unit 34 are illustrated as being mounted on frame 200 (see FIG. 3). Toner cartridge 35 is also removably mounted in the frame 90 of imaging forming device 22 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34. Both imaging unit 32 and toner cartridge 35 are replaceable items for imaging forming device 22.

The electrophotographic imaging process is well known in the art and, therefore, will be briefly described. During an imaging operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39. Next, the toned image is fused to the media sheet in fuser 37 and sent to an output location or to one or more finishing options such as a duplexer, a stapler or a hole-punch. Toner remnants are removed from the photoconductive drum by the waste toner removal system housed within cleaner unit 33. As toner is depleted from developer unit 34, toner is transferred from toner cartridge 35 into developer unit 34. Controller 28 provides for the coordination of these activities occurring during the imaging process.

Figure 2:
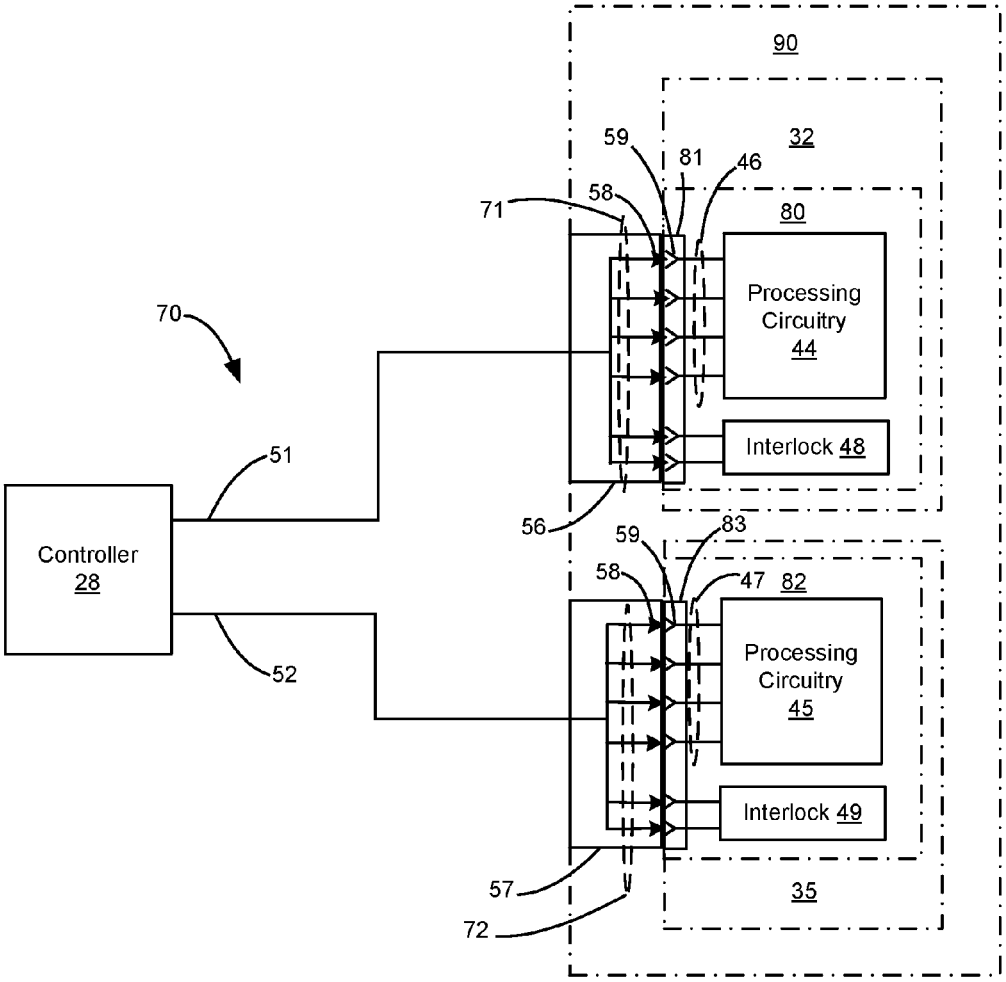
FIG. 2 is a simplified schematic diagram of the interlocks/connectors, processing circuitry and controller of the image forming device.

With reference to FIG. 2, a simplified circuit 70 of the connection between controller 28 and first and second processing circuitry 44, 45 is shown mounted in retainers 80, 82 (shown in phantom lines) on imaging unit 32 and toner cartridge 35 (shown in phantom lines), respectively. First and second connectors 56, 57 mounted on frame 90 (shown in phantom lines) are provided in communication with communication links 51, 52, respectively, to engage with processing circuitry 44, 45 respectively. First and second connectors 56, 57 are positioned on frame 90 adjacent the operating positions of imaging unit 32 and toner cartridge 35, respectively, within image forming device 22 and are coupleable with retainers 80, 82 and processing circuitry 44, 45 as discussed in more detailed herein.

Each of first and second connectors 56, 57 has one or more contact pads or pins 58 engaging a corresponding number of contacts or terminals 59 provided at retainers 80, 82 that are electrically connected to corresponding terminals on processing circuitry 44, 45 via leads 46, 47, respectively. In an example embodiment, each of retainers 80, 82 have connectors 81, 83 having four terminals 59 providing connections for ground, power, and data communications such as a 2-wire bus for processing circuitry 44, 45. As shown, two additional contact pads/pins 58 and terminals 59 interconnect interlocks 48, 49 to controller 28. The number of contact pads/pins 58 and terminals 59 is a matter of design choice. Interlocks 48, 49 are provided to ensure that imaging unit 32 and toner cartridge 35 are both installed in their respective operating positions OP1, OP2 (see FIG. 3) within image forming device 22 before the laser in the LSU 31 can be turned on. In one form, interlocks 48, 49 are metal shorting bars mounted on connectors 81, 83 that interconnect or short two corresponding contact pads/pins 58 in connectors 56, 57, respectively. If both pairs of contact pads/pins 58 are not shorted, the power path to the laser is open and the laser cannot turn on.

Figure 3:
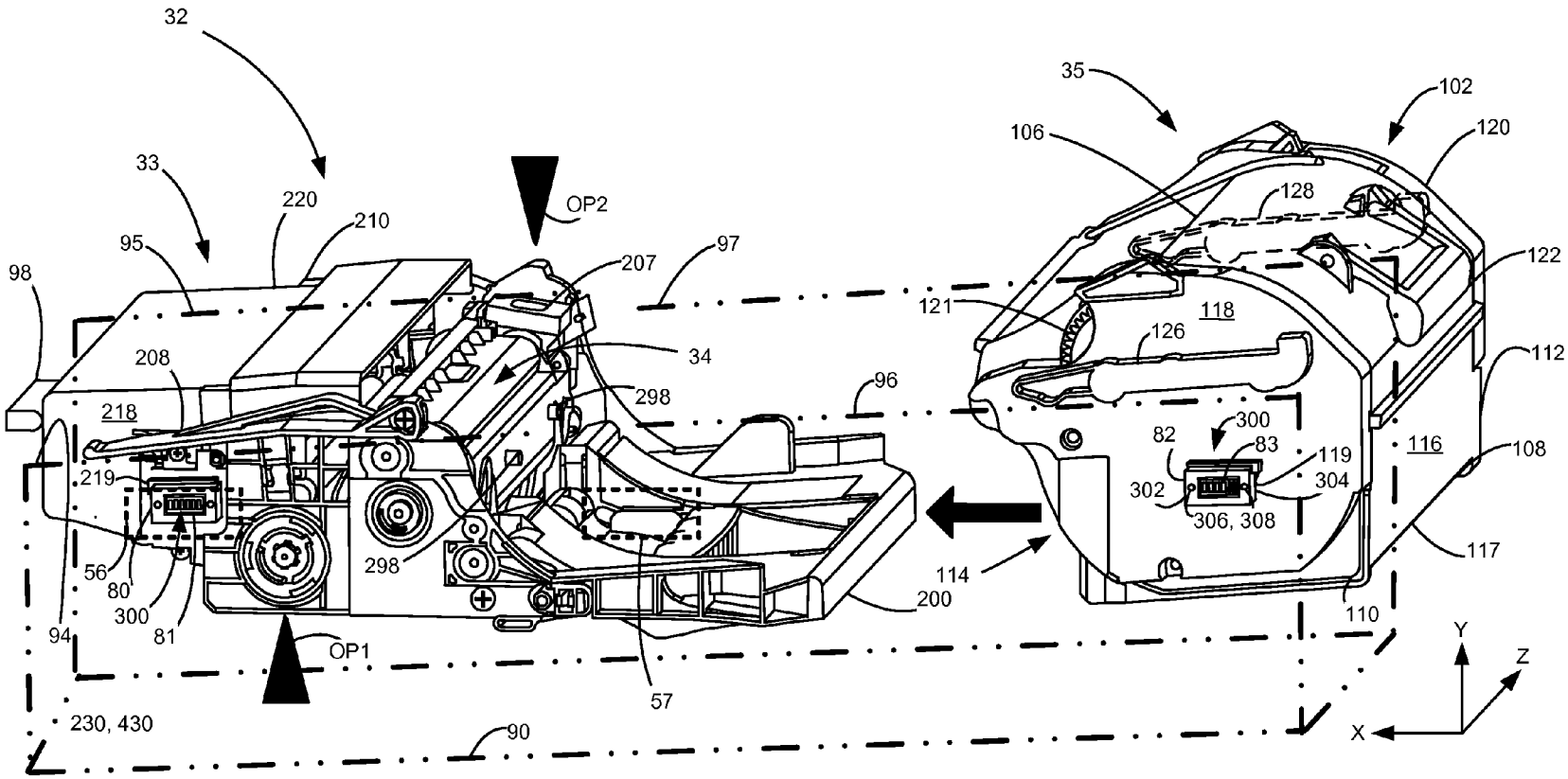
FIG. 3 is a perspective view of an example toner cartridge and an imaging unit in a frame illustrating example locations of the interlock/connector system.

Referring to FIG. 3, frame 90 is used to establish the spatial relationship of the imaging unit 32, in particular, the photoconductive drum, to either the media to be printed or to an intermediate transfer member onto which the toned image on the photoconductive drum is transferred and the spatial relationship of connector 81 to connector 56. Frame 90, along with positioning features on toner cartridge 35, establishes the spatial relationship of toner cartridge 35 to imaging unit 32 and connector 83 to connector 57. In turn, alignment features 219, 119 on each of the imaging unit 32 and toner cartridge 35 engage with retainers 80, 82 for referencing retainers 80, 82 to imaging unit 32 and toner cartridge 35, respectively. Last, positioning features may be provided on retainers 80, 82 to locate the circuit boards for processing circuitry 44, 45 or interlocks 48, 49 on retainers 80, 82 allowing connectors 56, 57 and 81, 83 to be electrically engaged with processing circuitry 44, 45 and interlocks 48, 49, respectively.

In FIG. 3, a toner cartridge 35 and an imaging unit 32 are shown according to one example embodiment. Imaging unit 32 includes a developer unit 34 and a cleaner unit 33 attached to frame 200. Imaging unit 32 may be first slidably inserted into frame 90 within image forming device 22 in the insertion direction indicated by the arrow. Frame 90 is typically formed of a metal plate having at least two spaced and aligned side panels containing rails or channels 94-97 that are used to support imaging unit 32 and toner cartridge 35. Other combinations of materials including plastic may be used to fabricate frame 90. Imaging unit 32 is shown in frame 90 abutting a stop 98 provided either on frame 90 or within image forming device 22 at its operating position OP1 designated by the black triangle. Frame 200 is slidably engaged with frame 90 and supports cleaner unit 33 and developer unit 34. Imaging unit 32 may be provided with a pair of wing guides 208, 210 mounted on both first and second sides 218, 220 of frame 200 and/or cleaner unit 33 for guiding imaging unit 32 through the insertion path and for positioning the imaging unit 32 within the mounting frame 90 of image forming device 22. Wing guides 208, 210 are supported in channels or rails 94, 95, indicated by phantom lines, in the side panels of mounting frame 90.

Toner cartridge 35 is shown being inserted into frame 90 and frame 200 in the indicated insertion direction where it is guided by frame 200 until it abuts one or more stops 298 at which point toner cartridge 35 is positioned in a mating relationship with developer unit 34 of imaging unit 32 at its operating position OP2, also designated by the black triangle. At operating position OP2, an exit port on the front wall 114 and adjacent second side wall 112 of toner cartridge 35 is aligned with the inlet port 207 of developer unit 34. A pair of guides 126, 128 is provided on the end caps 118, 120 of toner cartridge 100 and is supported in channels or rails 96, 97, indicated by phantom lines in frame 90. This arrangement allows toner cartridge 35 to be removed and reinserted easily, such as when replacing an empty toner cartridge 35, without having to remove imaging unit 32. While rails or channels 94, 96 and 95, 97 are shown as being separate, rails or channels 94 and 96 and 95 and 97 may be one continuous rail or channel in the mounting frame 90.

Should a media jam occur beneath imaging unit 32, toner cartridge 35 and imaging unit 32 may be readily removed to allow access to the media jam. Developer unit 34, cleaner unit 33 and frame 200 may also be readily removed as desired in order to maintain, repair or replace the components associated with developer unit 34, cleaning unit 33 or frame 200. However, it will be appreciated that this typically occurs with less frequency than the removal and reinsertion of toner cartridge 35.

Toner cartridge 35 includes a housing 102 having an enclosed reservoir for holding a quantity of toner therein. Housing 102 may be viewed as having a top or lid 106 mounted on a base 108. Base 108 is formed by first and second side walls 110, 112 connected to adjoining front and rear walls 114, 116 and bottom 117. In one embodiment, top 106 is ultrasonically welded to base 108 thereby forming the enclosed toner reservoir. Housing 102 also includes first and second end caps 118, 120 that are mounted to side walls 110, 112, respectively. First and second end caps 118, 120 may be snap fitted into place or attached by screws or other fasteners onto base 108. Various gears and/or linkages are housed within the space between end cap 118 and side wall 110 and between end cap 120 and side wall 112. These gears and linkages are used for operation of mechanical interlocks that engage with imaging unit 32 and for operation of a toner delivery system within toner cartridge 35. The toner deliver system includes a toner paddle assembly, feed auger, gear train, and exit port shutter for the exit port. A main interface gear 121 for toner cartridge 35 is mounted in end cap 118. Main interface gear 121 receives torque from a drive system housed within image forming device 22 and in turn drives the feed auger and the toner paddle assembly through one or more intermediate gears for the delivery of toner from toner cartridge 35. A handle 122 may be provided on top 106 or base 108 of toner cartridge 35 to assist with insertion and removal of toner cartridge 35 from imaging unit 32 and image forming device 22.

Figure 4:
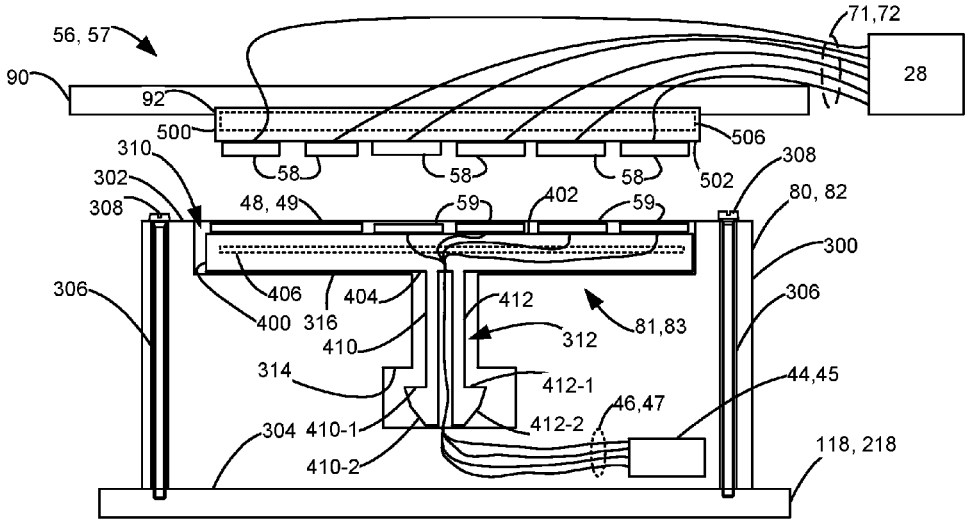
FIG. 4 is a simplified illustration of the interlock connector system shown in FIG. 3.

Referring to FIGS. 3-4, mounted on each of imaging unit 32 and toner cartridge 35 is a retainer 80, 82, respectively. Provided on frame 90 are corresponding connectors 56, 57 for each retainer 80, 82 at a predetermined position adjacent to the operational positions OP1, OP2 of imaging unit 32 and toner cartridge 35, respectively. In one form, retainers 80, 82 may contain connectors 81, 83, processing circuitry 44, 45, and interlocks 48, 49, respectively. In another form, retainers 80, 82 may contain processing circuitry 44, 45 but not interlocks 48, 49 or interlocks 48, 49 but not processing circuitry 44, 45. The individual construction and combination of the described features is a matter of design choice. The connectors 56, 57 and 81, 83 will also vary in accordance with the features provided on retainers 80, 82. The number of contacts or interlocks provided should not be considered to limit the present design.

As shown in FIGS. 3-4, retainers 80, 82 each include a block 300 having a top surface 302 and a bottom surface 304 and one or more mounting holes 306 extending between the top and bottom surfaces 302, 304. Fasteners 308 may be provided to attach retainers 80, 82 to a surface of first side 218 of imaging unit 32 and first end cap 118 of cartridge 35, respectively. The manner of attachment of retainers 80, 82 should not be considered as a limitation of the design. For example, retainers 80, 82 may be formed integrally with first side 218 and end cap 118, respectively. As shown, retainers 80, 82 are attached to first side 218 and first end cap 118 of imaging unit 32 and toner cartridge 35, respectively. In each of retainers 80, 82, an opening 310 is provided in top surface 302 and sized to loosely receive a respective connector 81, 83. Connectors 81, 83 each include a support 400 and one or more contacts 59 or interlocks 48, 49. Support 400 is shown having a planar outer surface 402 which may be polygonal or elliptical, for example. One or more contacts 59 and interlocks 48, 49 are mounted on outer surface 402 of support 400. Contacts 59 and interlocks 48, 49 are electrically conductive and illustrated as being generally planar; however, other configurations may be used and are a matter of design choice. Contacts 59 and interlocks 48, 49 may be fastened to support 400 by adhesives, fasteners, by a press fit, etc. The manner of attachment of contacts 59 and interlocks 48, 49 should not be construed as a limitation of the device. One of support 400, contacts 59 and interlocks 48, 49 may have a portion that includes either a magnet or a ferromagnetic material. For purposes of illustration only and not limitation, a steel plate 406 (in phantom line) is shown embedded in support 400.

In one example embodiment, a portion 312 of opening 310 is extended into block 300 in the form of an inverted T forming an undercut surface 314 adjacent the distal end of portion 312. Depending from a bottom surface 404 of support 400 are legs 410, 412, each having a latch portion 410-1, 412-1 extending therefrom. The distal ends 410-2, 412-2 of legs 410, 412 may be rounded to facilitate their insertion into opening portion 312. As legs 410, 412 are inserted into portion 312, they flex toward each other, as viewed, allowing latch portions 410-1, 412-1 to pass into portion 312. Legs 410, 412 then flex outwardly as latch portions 410-1, 412-1 pass undercut surface 314 that serves as a catch 314 for latch portions 410-1, 412-1. The distance between latch portions 410-1 and 412-1 and bottom surface 404 is greater than the distance between catch 314 and a surface 316 of opening 310 that faces bottom surface 404. This allows support 400 to move a limited distance out of opening 310 but remain connected to block 300. As will be appreciated, other forms of loosely attaching support 400 to either block 300 or directly to the replaceable item, such as toner cartridge 35, may also be used.

Also shown mounted on block 300 is processing circuitry 44, 45. A plurality of leads 46, 47 interconnect corresponding ones of a plurality of terminals on processing circuitry 44, 45 with corresponding ones of the one or more contacts 59 provided on outer surface 402 of support 400 of connectors 81, 83. Leads 46, 47 may pass through opening portion 312 and be routed through support 400.

Connectors 56, 57 are mounted on frame 90. Each of connectors 56, 57 is comprised of a support 500 that is mounted to frame 90. As shown, support 500 is press fit into a corresponding sized recess 92 in frame 90. Other forms of attaching support 500 to frame 90 may also be used as is known to those of ordinary skill in the art. Support 500 is shown having a planar outer surface 502 which may be polygonal or elliptical, for example. One or more contacts 58 are mounted on outer surface 502 of support 500. Contacts 58 are electrically conductive and illustrated as being generally planar; however, other configurations may be used and are a matter of design choice. Contacts 58 may be fastened to support 500 by adhesives, fasteners, by a press fit, etc. The manner of attachment of contacts 58 should not be construed as a limitation of the device. Provided in or on support 500 is a magnet 506. For purposes of illustration only and not limitation, magnet 506 (in phantom line) is shown embedded in support 500. A plurality of leads 71, 72 of communication links 51, 52 interconnect corresponding ones of the one or more contacts 58 provided on outer surface 502 of support 500 to controller 28. Leads 71, 72 may be routed through support 500.

Figure 5A:
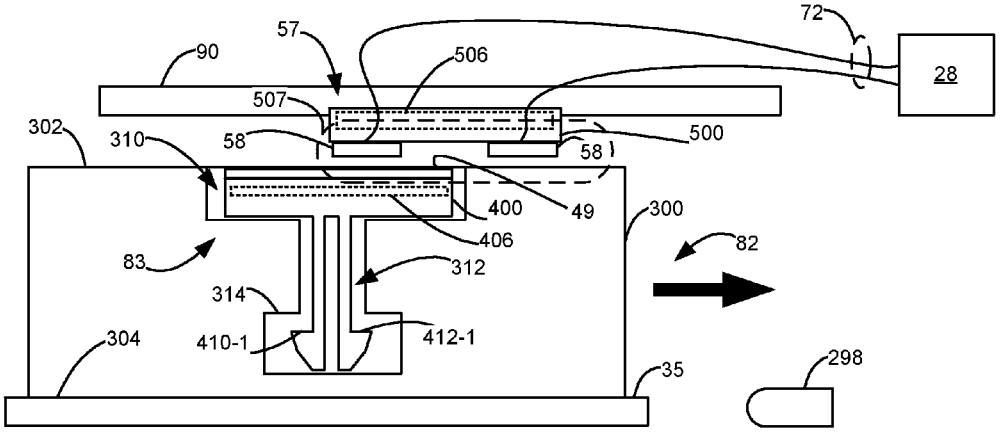
FIGS. 5A-5B are schematic view of one embodiment of an interlock/connector system comprised of an interlock.
Figure 5B:
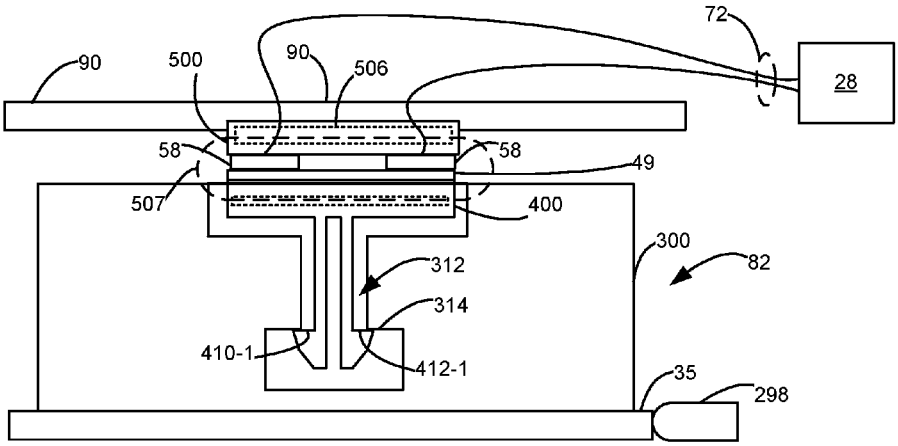

Referring now to FIGS. 5A-5B, the interoperation of connectors 57 and 83 is illustrated. Connectors 56 and 81 interoperate in a similar manner. Illustrated in FIGS. 5A-5B is the interoperation of interlock 49 on connector 83 and a pair of contacts 58 on connector 57.

In FIG. 5A, toner cartridge 35 is shown approaching stop 298. Support 400 is in its initial position within opening 310 on block 300 and is entering a magnetic field 507 of magnet 506 on connector 57. There is a gap between interlock 49 on connector 83 and contacts 58 on connector 57 allowing toner cartridge 35 to be inserted into frame 90. In FIG. 5B, toner cartridge 35 has reached and is abutting stop 298 at which point connectors 57 and 83 are substantially aligned. The magnetic field 507 of magnet 506 acts upon plate 406 and draws support 400 out from its initial position causing interlock 49 of connector 83 to electrically interconnect or short out contacts 58 of connector 57 providing a signal via leads 72 to controller 28. The magnitude of magnetic field 507 is sufficient to draw support 400 into contact with support 500 but is not sufficient to impede removal of toner cartridge 35.

Figure 6:
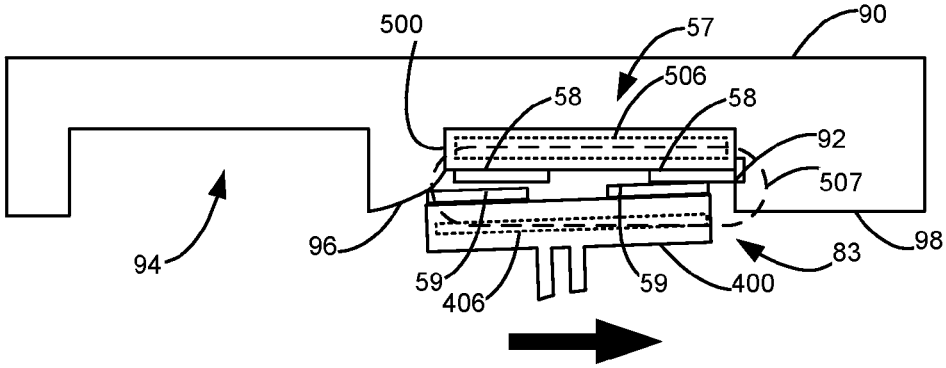
FIGS. 6-8 schematically illustrate alternative arrangements for the connector/interlock system having two connections.
Figure 7:
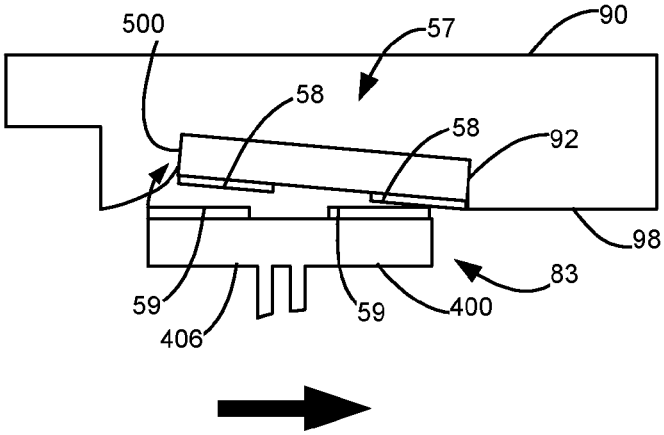
Figure 8:
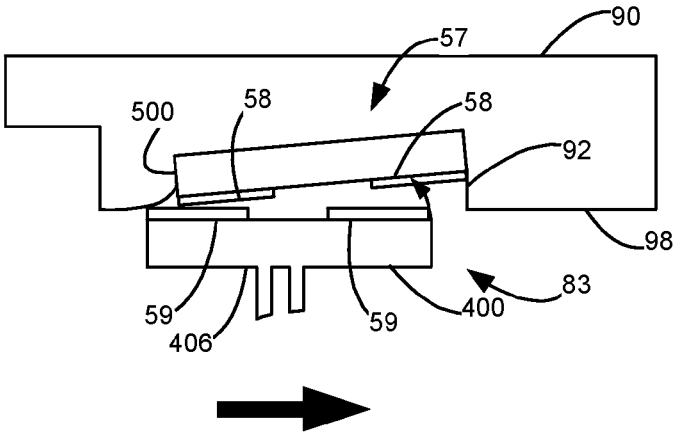

In FIGS. 6-8 various alignment configurations of connector 57 and connector 83 are shown. Similar configurations may be used for connector 56 and connector 81.

In FIG. 6, a notch 94 is provided in frame 90 upstream of connector 57 with respect to the insertion direction. Notch 94 is sized to receive support 400 of connector 83. Recess 92 has been deepened so that contacts 58 of connector 57 are positioned at or below the surface 98 of frame 90. Recess 92 is also provided with a chamfered surface 96 on the upstream end of recess 92 allowing for support 400 and contacts 59 to more readily move into contact with corresponding contacts 58 on support 500 due to the influence of magnetic field 507 of magnet 506. Similarly, during removal of toner cartridge 35, chamfered surface 96 facilitates separation of the contacts 59 from contacts 58.

In FIG. 7, connector 57 is set at an acute angle with respect to the insertion direction. As shown, the downstream end of connector 57 is closer to the surface 98 of frame 90 adjacent to insertion path of toner cartridge 35. During insertion of toner cartridge 35, the downstream contact 59 of connector 83 makes contact with the downstream contact 58 of connector 57 before the upstream contact 59 of connector 83 makes contact with the upstream contact 58 of connector 57. As toner cartridge 35 moves toward its operating position, connector 83 and support 400 pivot, as indicated by the curved arrow, about the point of contact between downstream contacts 58 and 59 allowing the remaining upstream contacts 58 of connector 57 to connect with their corresponding upstream contacts 59 of connector 83. Opening 310 and portion 312 thereof are sized to allow the pivoting motion of support 400. Downstream contacts 58, 59 may, for example, complete an electrical ground circuit prior to power and communication connections being made.

In FIG. 8, connector 57 is set at an acute angle that is reversed from that shown in FIG. 7. As shown, the upstream end of connector 57 is closer to the surface 98 of frame 90 adjacent to insertion path of toner cartridge 35. During insertion of toner cartridge 35, the upstream contact 59 of connector 83 makes contact with the upstream contact 58 of connector 57 before the downstream contact 59 of connector 83 makes contact with the downstream contact 58 of connector 57. As toner cartridge 35 moves toward its operating position, connector 83 and support 400 pivot, as indicated by the curved arrow, about the point of contact between upstream contacts 58 and 59 allowing the remaining downstream contacts 58 of connector 57 to connect with their corresponding downstream contacts 59 of connector 83. Opening 310 and portion 312 thereof are sized to allow the pivoting motion of support 400.

Figure 9:
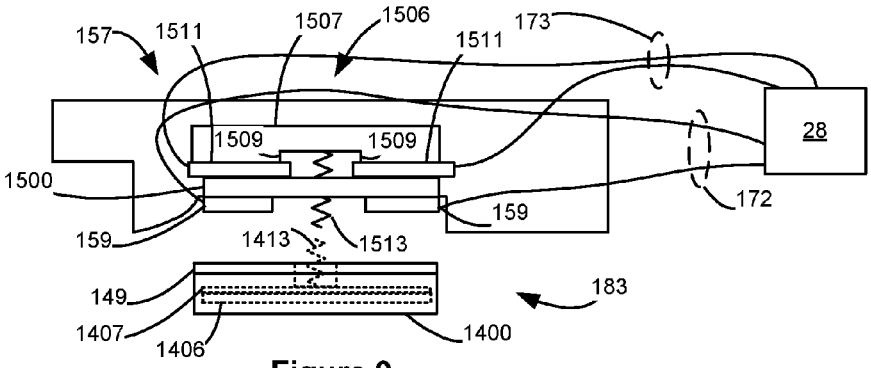
FIG. 9 schematically illustrates an alternate embodiment for the connector/interlock system.

In FIG. 9, another form of connectors 57 and 83 is shown. Connector 157 includes a support 1500 having one or more contacts 159 mounted thereto connected to controller 28 via leads 172. Adjacent support 1500 is electromagnet 1506 comprised of a U-shaped magnetic core 1507 and a pair of coils 1511, a coil positioned about each leg of the pair of legs 1509. Coils 1511 are connected to controller 28 via leads 173. Connector 183 is substantially the same as connector 83 and is comprised of a support 1400 on which interlock 149 is shown. One or more contacts may also be provided as previously discussed. Plate 1406 may be provided on or within support 1400. When coils 1511 are energized by controller 28, the magnetic field created by electromagnet 1506 draws plate 1406 and support 1400 and interlock 149 toward support 1500 and into contact with contacts 159 of connector 157. When coils 1511 are deenergized, connector 183 disconnects from connector 157. A spring 1513 mounted on or adjacent support 1500 or a spring 1413 mounted adjacent support 1400 may be provided to assist with the separation of connector 183 from connector 157. In addition, a layer of a non-magnetic or diamagnetic material 1407, such aluminum foil 1407, may also be provided. Foil 1407 acts to interrupt the residual magnetic circuit formed of core 1507 and plate 1406 when electromagnet 1506 is deenergized.

Figure 10:
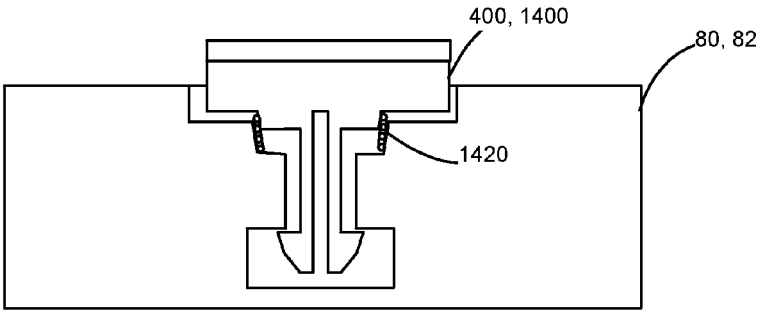
FIGS. 10-12 schematically illustrate alternate biasing arrangements for the replaceable item portion of the interlock/connector system.
Figure 11:
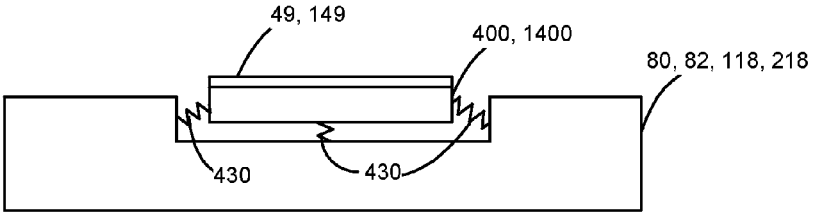
Figure 12:
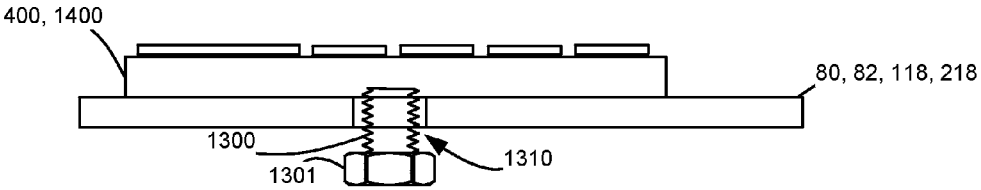

FIGS. 10-12 illustrate alternative mounting configurations for support 400, 1400. In FIG. 10, a spring 1420 connects support 400, 1400 to retainer 80, 82 and biases support 400, 1400 toward retainer 80, 82. Spring 1420 extends as support 400, 1400 is drawn toward corresponding connector 57, 157. In FIG. 11, support 400, 1400 is mounted on first end cap 118 or first side 218 by one or more springs 430 which act to bias support 400, 1400 onto the surface of end cap 118 or first side 218. In FIG. 12, support 400, 1400 may be loosely mounted to the surface of retainers 80, 82, first end cap 118, or first side 218 using a fastener 1300, such as screw 1300. Screw 1300 passes through opening 1310 in the surface of retainers 80, 82, first end cap 118, or first side 218, into support 400, 1400. The head 1301 of screw 1300 limits the travel of support away from the surface.

Figure 13:
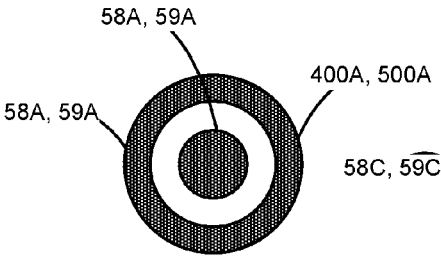
FIGS. 13-19 illustrate various contact arrangements for the interlock/connector system.
Figure 14:
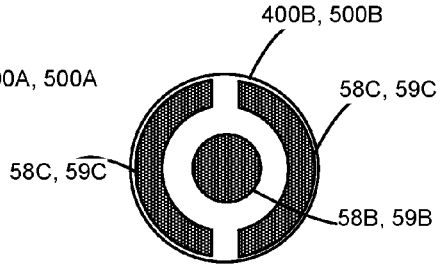
Figure 15:
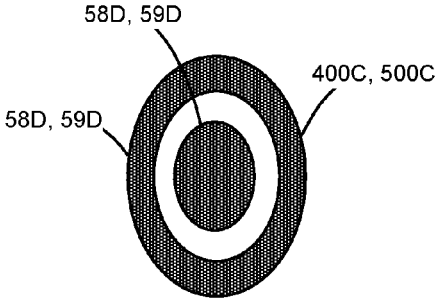
Figure 16:
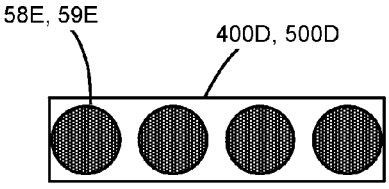
Figure 17:
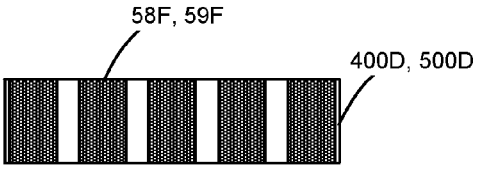
Figure 18:
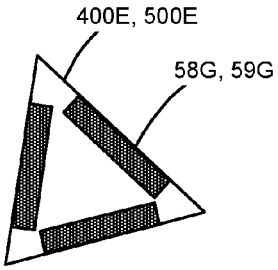
Figure 19:
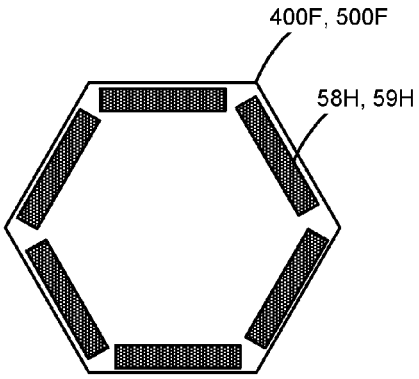

FIGS. 13-19 illustrate various configurations for the supports 400, 500 and contacts 48, 49, 58, 59. FIGS. 13-15 illustrate circular and elliptical supports. FIG. 13 shows two concentric contacts 58A, 59A mounted on circular supports 400A, 500A. FIG. 14 illustrates three contacts, a centered circular contact 58B, 59B positioned between two arcuate contacts 58C, 59C. FIG. 15 illustrates an elliptical support 400C, 500C having two concentric contacts 58D, 59D. FIGS. 16 and 17 illustrate a rectangular support 400D, 500D having circular contacts 58E, 59E and rectangular contacts 58F, 59F, respectively. FIG. 18 illustrates a triangular support 400E, 500E having three rectangular contacts 58G, 59G along each side of the support. FIG. 19 illustrates a polygonal support 400F, 500F having rectangular contacts 58H, 59H along each side. Other support shapes and contact configurations may be used and the shape of the support and contacts should not be considered to be a limitation of the device.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

The invention claimed is:

1. A connector mountable on an exterior surface of a replaceable item for use in an image forming device, the connector interconnectable with a second connector of the image forming device, the second connector having a magnet positioned within the image forming device adjacent to an operating position of the replaceable item, the connector comprising:

a support loosely attachable to the exterior surface of the replaceable item allowing the support to be drawn away from the exterior surface of the replaceable item and remain attached to the replaceable item; and at least a portion of the connector being magnetically attractable to the magnet of the second connector, wherein when the connector is attached to the exterior surface of the replaceable item and the replaceable item is in the operating position, a magnetic field of the magnet of the second connector draws the support away from the exterior surface of the replaceable item and the connector into operational contact with the second connector.

2. The connector of claim 1, wherein the portion of the connector being magnetically attractable includes the support having a ferromagnetic plate.

3. The connector of claim 1, wherein the portion of the connector being magnetically attractable includes the support having a magnet.

4. The connector of claim 1, further comprising a pair of opposed spaced legs depending from the bottom surface of the support positioned to attach the support to the exterior surface of the replaceable item.

5. The connector of claim 4, further comprising a latch formed on at least one of the legs positioned to retain the support on the replaceable item.

6. A replaceable item for use in an image forming device, the image forming device having a second connector and a magnet positioned within the image forming device adjacent to an operating position of the replaceable item, the replaceable item comprising:

a housing having an exterior surface;

a connector on the exterior surface of the housing comprising:

a support loosely retained by the housing allowing the support to move away from the exterior surface of the housing and remain attached to the housing; and at least a portion of the connector being magnetically attractable to the magnet of the image forming device, wherein when the replaceable item is installed in the operating position, a magnetic field of the magnet of the image forming device draws the support of the connector of the replaceable item away from the exterior surface of the housing and the connector into operational contact with the second connector of the image forming device.

7. The replaceable item of claim 6, wherein the portion of the connector being magnetically attractable includes the support having a ferromagnetic plate.

8. The replaceable item of claim 6, wherein the portion of the connector being magnetically attractable includes the support having a magnet.

* * * * *